United States Patent [19]

Papayoti

[11] 3,994,111

[45] Nov. 30, 1976

[54] SPACE FRAME BUILDING CONSTRUCTION

[75] Inventor: Hristo V. Papayoti, Ann Arbor, Mich.

[73] Assignee: Unistrut Corporation, Wayne, Mich.

[22] Filed: Apr. 9, 1975

[21] Appl. No.: 566,222

Related U.S. Application Data

[62] Division of Ser. No. 363,367, May 24, 1973, abandoned.

[52] U.S. Cl. ..... 52/650; 52/489; 52/648

[51] Int. Cl.[2] ..... E04H 12/08

[58] Field of Search ..... 52/483, 489, 488, 495, 52/648, 650

[56] References Cited

UNITED STATES PATENTS

| | | | |
|---|---|---|---|
| 2,284,898 | 6/1942 | Hartman | 52/650 |
| 2,803,858 | 8/1957 | Rader | 52/489 |
| 2,969,754 | 1/1961 | Wilson | 52/474 |
| 3,221,588 | 12/1965 | Wieber | 52/363 |
| 3,415,027 | 12/1968 | Snyder | 52/655 |
| 3,443,348 | 5/1969 | Papayoti | 52/650 |
| 3,477,189 | 11/1969 | Merson | 52/648 |
| 3,583,121 | 6/1971 | Tate | 52/648 |
| 3,598,686 | 8/1971 | Clark | 52/650 |
| 3,748,793 | 7/1973 | Tompkins | 52/474 |

FOREIGN PATENTS OR APPLICATIONS

| | | | |
|---|---|---|---|
| 636,273 | 2/1962 | Canada | 52/650 |
| 2,160,281 | 7/1972 | Germany | 52/483 |
| 6,617,750 | 11/1967 | Netherlands | 52/467 |

*Primary Examiner*—Ernest R. Purser
*Assistant Examiner*—Henry Raduazo
*Attorney, Agent, or Firm*—Gifford, Chandler & Sheridan

[57] ABSTRACT

A construction for a space frame system of the type wherein an upper chord frame and a lower chord frame structure are formed of a plurality of strut members connected to each other and held together by a plurality of connecting fixtures and web struts. The cord struts are of an improved form which adds to the structural strength of the space frame assembly. The struts are bent or otherwise formed into elongated channels which include a pair of outwardly and sidewardly projecting lip portions which are oriented in a plane substantially parallel to the channel bottom portion. The lip portions provide attachment surface portions which allow a great variety of mounting and support connections.

2 Claims, 8 Drawing Figures

SPACE FRAME BUILDING CONSTRUCTION

This application is a division of Ser. No. 363,367 filed May 24, 1973 and now abandoned.

BACKGROUND OF THE INVENTION

1. Field of the Invention

The present invention relates to building constructions and the like and, more particularly, to improved types of struts for space frame systems for providing an improved load carrying structural capacity and additional versatility in attaching conjunctive building components and systems.

2. Description of the Prior Art

The C. W. Attwood Pat. No. 3,270,478, C. W. Attwood et al U.S. Pat. No. 3,421,280, and H. V. Papayoti U.S. Pat. No. 3,443,348, all of common ownership with the present application, disclose a standardized system of space frame construction involving the use of lightweight, interchangeable elements of high quality material, manufactured to close tolerances, that can be assembled at a very low cost even by relatively inexperienced workers to form structures varying greatly in design and capable of being readily disassembled, altered, or expanded to meet the changing needs of the user, the components being almost completely salvageable to permit relocation and reuse. Such a flexible type of structural framework is well suited for many different types of buildings, pavilions, three dimensional trusses, structural spans and the like. In addition, such a structural framework meets not only requirements of flexibility, standardization and high quality, but is capable of carrying large loads and can be engineered to form space enclosures of various sizes and shapes instead of being limited to certain overall fixed dimensions as is the case with conventional structures.

As disclosed in the aforesaid patents, a space frame is a structure in which forces act in three or more directions in space. The structure uses four substantially standardized basic parts; namely, connection fixtures struts, bolts and nuts. The essence of the four basic parts is a preformed universal connecting fixture having horizontally and angularly oriented seats with accurate locating and securing means to which the struts are secured by the nuts and bolts. The space frame system can be applied in assembly roof span constructions as well as floors and other structures.

Until the appearance on the market of space frames, known by the trademarks "UNISTRUT" and "ATTWOOD SYSTEM," trusses and similar parts used in roofs, floors and other building structures were either welded together and carried in assemblies to the construction site or were assembled by welding, riveting or bolting in the field. Specified parts, which individually were adapted for only one specialized use, had to be altered as necessary as construction progressed. The shortcomings and inconveniences of prior construction systems have been overcome by the space frame system of construction utilizing lightweight, easily handled modular parts. Since these parts are manufactured in large quantities and are accurately dimensioned, the interchangeability of the parts is a considerable advantage. The precision with which parts are made in the factory insures speed and accuracy in assembly. The parts arrive on the site prefinished and are readily joined together. Workmen do not have to use tapes or squares and the simplicity of assembly even permits the employment of relatively unskilled labor.

Such space frame structures provide a building construction having a floor structure or a roof structure that is held at a predetermined distance above the ground and has appropriate load carrying capacity and characteristics. The struts must be of a design permitting attachment in a variety of positions so that they can readily be attached to support a roof or floor deck, ceiling panel, mechanical, electrical, air conditioning and other like distribution systems.

SUMMARY OF THE INVENTION

The present invention, which will be described subsequently in greater detail, is adapted to a space frame system including a lower chord frame structure and an upper chord frame structure disposed in parallel and horizontally disposed planes. A stress distributing web structure spaces and connects the lower and the upper chord frame structure of each space frame system. The chord frames and web structure are formed of stress carrying channel strut members interconnected at their ends by standardized connecting fixtures which are regularly spaced along a plurality of longitudinal and lateral rows.

The invention more particularly comprises improved types of struts useful in space frames of the type above described, which struts are of a form tending to add to their structural rigidity and load bearing strength. The manner in which the side lip portions extend provides an additional horizontal surface to which roof or floor elements may be attached either by metal screws, by welding, or other fastening devices. It is particularly useful in space frames to have a properly oriented surface on the struts which facilitates the ready attachment of a steel deck.

Other objects, advantages and applications of the present invention will become apparent to those skilled in the art of space frame structures when the accompanying description of several examples of the present invention is read in conjunction with the accompanying drawings.

BRIEF DESCRIPTION OF THE DRAWINGS

The description herein makes reference to the accompanying drawings wherein like reference numerals are used to refer to like parts throughout the several views and in which.

DESCRIPTION OF THE PREFERRED EMBODIMENTS

Figure 1:
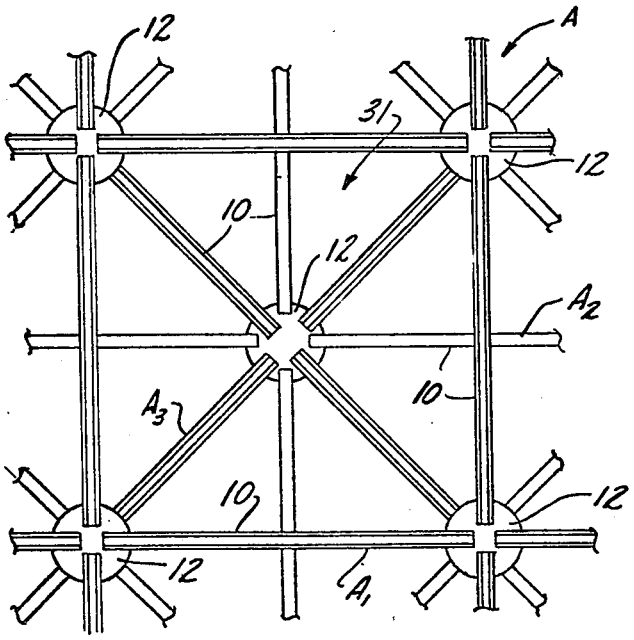
FIG. 1 is a fragmentary top plan view of a space frame structure including connecting fixtures and struts.
Figure 2:
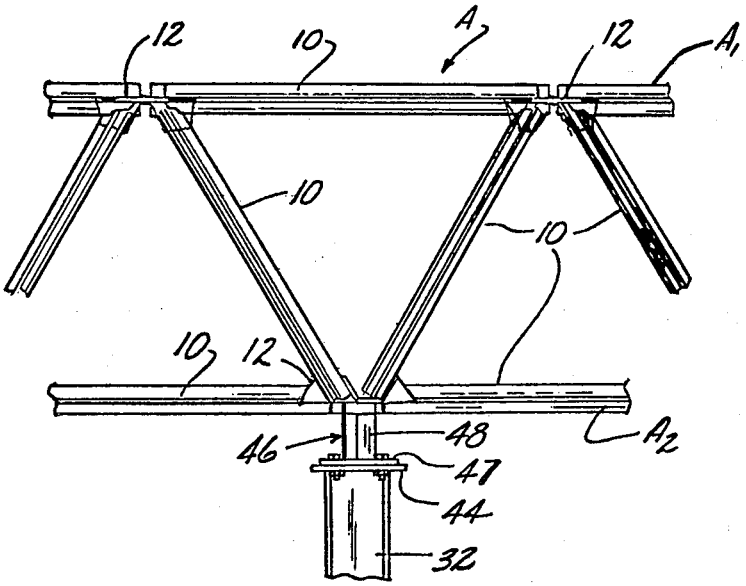
FIG. 2 is a fragmentary elevational view of the space frame structure of FIG. 1.

Referring now to the drawings and more particularly to FIGS. 1 and 2, these illustrate an example of a space frame construction. The space frame construction, generally indicated by A, includes an upper chord frame structure $A_1$ and a lower chord frame structure $A_2$ held together in spatial relationship by means of an intermediate stress distributing web structure $A_3$. The upper and lower chord frame structures and the web structure are preferably assembled from a plurality of strut members 10 which are generally channel-shaped. The chord frame struts 10 have a particular construction which will be shown in detail in FIGS. 3 and 5–8 hereinafter.

The upper and lower chord frame structures $A_1$ and $A_2$ further include a plurality of connecting fixtures 12 which will likewise be shown in FIG. 4 hereinafter. Each strut member 10 is mounted to the surface of its corresponding connecting fixtures 12 by means of appropriate bolt and nut fasteners as shown and described in the aforementioned United States patents. It is important that each strut member 10 be properly aligned and located relative to its connecting fixtures 12. The manner in which this is accomplished is preferably by a mating lug and opening arrangement which will be clarified in the later description covering the FIGS. 3 and 4 drawings. The final form of the space frame A is that of an upper chord frame structure $A_1$ which lies in a plane parallel to the plane of the lower chord frame structure $A_2$, with the strut members 10 in each chord frame structure being arranged in squares, the intersection of the squares of one plane being vertically opposite the center of squares in the other plane as best shown in the FIG. 1 drawing. The intersection of the squares in one plane are joined to those in the other plane by the diagonally arranged web struts 10, forming the web structure $A_3$, such that the resulting structure consists of a plurality of four-sided pyramids set together right-side-up and up-side-down with all edges substantially the same length. In such a space frame arrangement, a single connecting fixture 12 can accommodate, for example, eight struts or eight pairs of struts, with each strut 10 being secured to the appropriate opening of a connecting fixture 12 by a single nut 22*a* and bolt 22*b* as best shown in FIG. 4.

A preferred support column arrangement for the space frame A includes a vertical upright column 32 suitably anchored at its lower end to a footing in the ground (not shown). The top of the upright column 32 is provided with a horizontal end plate 44 welded or otherwise fastened to the top of the column 32. The upper surface of the plate 44 has mounted on it a substantially short pedestal seat fitting 46 which includes a post portion 48 having a plate 47 on the bottom thereof, preferably attached to the plate 44 by bolting, welding or the like. An upper end of the seat fitting 46 is adapted to be fastened within the channel of the lower strut member 10 and to the bottom face of the connecting fixture 12 forming part of the lower chord frame structure $A_2$ by means of the same fastening device used for fastening thereon the lower chord frame strut 10.

Figure 3:
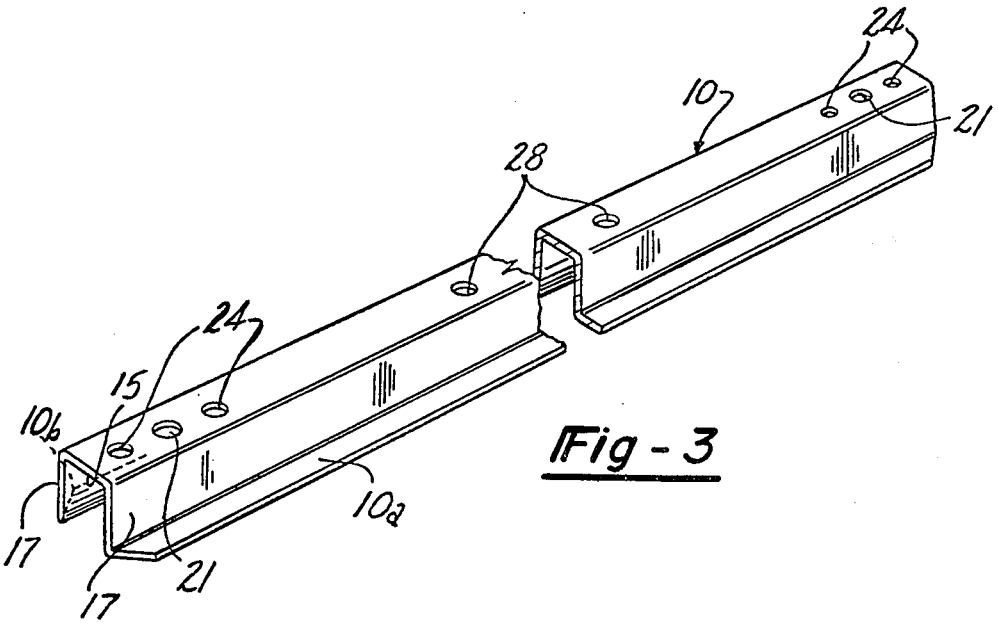
FIG. 3 is a fragmentary perspective view showing a strut constructed in accordance with the present invention.
Figure 4:
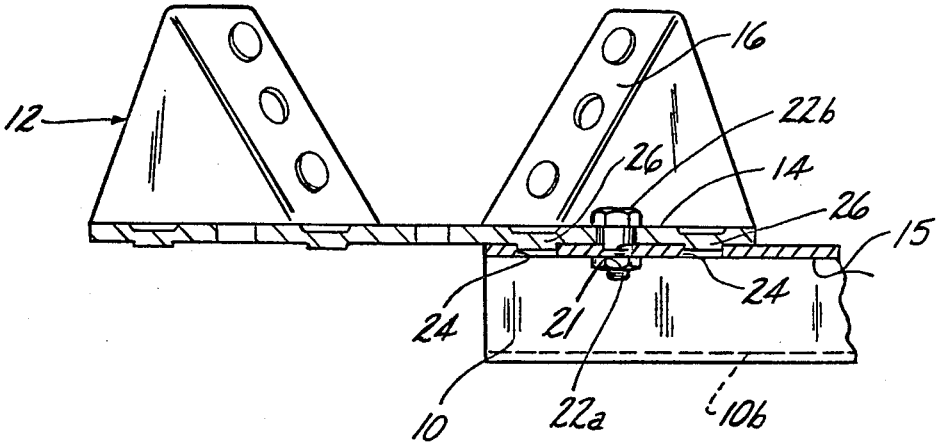
FIG. 4 is an elevational view partly in section illustrating the manner in which a chord strut and fixture are connected one to the other in one of the horizontally oriented chord frames.

FIGS. 3 and 4 show the basic parts of the space frame and particularly the configuration of the fixtures 12 and strut 10. The strut 10 includes a pair of side portions 17 which are substantially vertical to its bottom portion 15 and are symmetrically arranged relative to it. A pair of projecting lip or edge portions 10*a* and 10*b* extend from the two side portions 17 and lie in a horizontal plane substantially parallel to the plane of the bottom portion 15. Also included in the bottom portion 15 are lug hole openings 24, which openings are adapted to receive the projecting extensions of lugs 26 formed in the mating surface of the connecting fixture 12 as better shown in FIG. 4. A variety of combinations of lugs and openings in the fixtures and struts may be employed to insure proper alignment and fastening of the first one relative to the other and to add to the strength of the fixture assembly and the space frame. Intermediate bolt openings 21 are additionally included as shown.

The FIG. 4 drawing illustrates the manner in which one of the chord struts 10 is attached to the lower face of the horizontal flat seat 14 of the fixture 12 to provide a transverse horizontal mounting surface adapted to support and fasten conjunctive building components, such as ceiling panels, metal decks and the like, to complete the construction of the building in which the space frame is incorporated. A nut 22*a* and bolt 22*b* are shown holding together the chord strut 10 and fixture 12.

Figure 5:
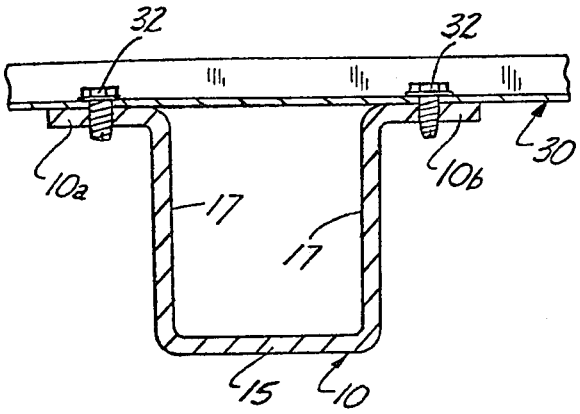
FIG. 5 is a cross-sectional view of a strut similar to that shown in FIG. 3 and shows the mode of attachment of a metal deck to the strut when it is connected as a top chord strut.

FIG. 5 illustrates the manner in which a metal deck 30 is attached to one of the struts 10 lying in the top chord frame $A_1$. Illustrated is the manner in which the metal deck 30 is attached through a plurality of self-tapping metal screws 32 extending through its lower face and holding it to the extending lip portions 10*a* and 10*b*. It will be understood that any number of screws 32 may be arranged in any desired pattern to fasten the deck 30 to either or both of the lip portions 10*a* and 10*b*. It will be seen from the drawing of FIG. 5 that the projecting lip portions 10*a* and 10*b* provide an extended fastening surface integral with the strut 10, which makes possible metal screw attachments without interfering with the surface coating prefinished on the strut 10 and metal deck 30.

Figure 6:
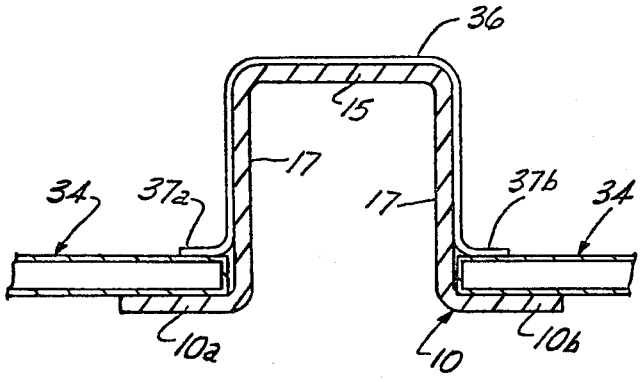
FIG. 6 is a cross-sectional view of a strut substantially similar to that shown in FIG. 5 but inverted in its position as a bottom chord strut and illustrating its connection to retain in place a pair of ceiling panels.

FIG. 6 shows a different arrangement for anchoring a pair of ceiling panels 34 to a chord strut 10 which is connected in the bottom chord frame $A_2$ as shown in FIGS. 1 and 2. In this modification, the strut 10 has the ceiling panels 34 held in place against the upper surface of its left hand and right hand lip portions 10*a* and 10*b* by a hold-down spring clip 36 with extended ends 37*a* and 37*b* which is snapped in holding engagement over the periphery of the strut 10. The extended side lip portions 10*a* and 10*b* again provide a horizontal mounting area of sufficient size and rigidity to anchor securely in place any of a variety of ceiling panel structures.

Figure 7:
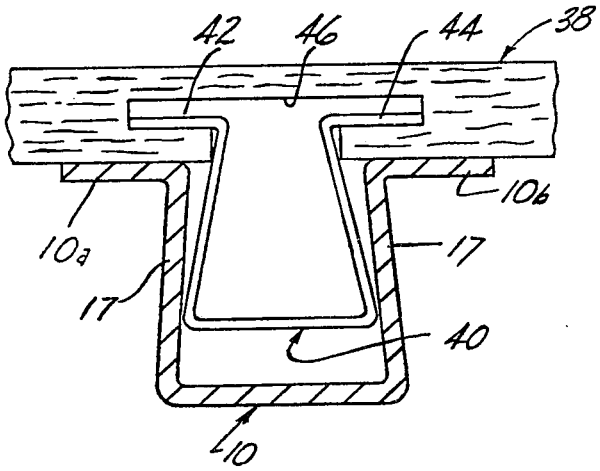
FIG. 7 is a cross-sectional view of a top chord strut similar to the strut shown in FIG. 5 but showing a somewhat different embodiment of the present invention with respect to the arrangement of two converging strut side portions and further illustrating the connection of a particle board or wood fiber plank to a top chord frame strut.

FIG. 7 illustrates the fastening arrangement of a strut 10 lying in the top chord frame $A_1$. A wood fiber plank 38 or like conjunctive building component is mounted firmly upon the projecting lip portions 10*a* and 10*b* of the strut 10. A spring clip 40 is used to hold the plank 38 down against the projecting lip portions 10*a* and 10*b* through the insertion of its deflectible end portions 42 and 44 in a properly sized tongue and groove opening 46 formed in the plank 38. It will be noted that in the FIG. 7 modification the strut side portions 17 are formed in a manner with one strut side portion 17 converging toward the other. The clip 40 has a similar shape so that once it is inserted in the opening 46 the plank 38 is anchored against movement with respect to the strut 10.

Figure 8:
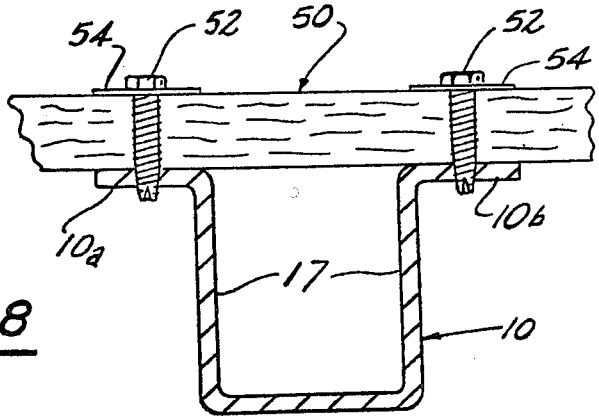
FIG. 8 is a still further embodiment of the present invention substantially similar to that shown in FIG. 5 but illustrating the mode of connecting a wood fiber plank or the like to a strut connected in the top chord frame.

FIG. 8 shows a chord strut 10 which is connected in the top chord frame $A_1$. The strut 10 is used to mount a particle board or wood fiber plank 50 against the upper surface of its sidewardly projecting lip portions 10*a* and 10*b*, and the member 50 is securely attached to the lip portions 10*a* and 10*b* through a plurality of self-tapping screws 52 mounted with fender washers 54 in the manner illustrated.

It will thus be seen that the several preferred embodiments of the present invention with respect to the modified structure and the lip portions of the chord struts not only provide a structural element of greater strength but make possible a great variety of available fastening arrangements whereby a great variety of conjunctive building components including roof or floor decks, ceiling panels, mechanical, electrical and other distribution systems may be mounted with struts connected in either the upper or lower chord frame.

What is claimed is:

1. A space framework construction comprising a plurality of elongated stress and load transmitting chord struts interconnected by a plurality of stress and load distributing fixtures to define upper and lower grid-like chord frame structures disposed in spaced parallel planes, a plurality of elongated stress and load transmitting struts, each connecting respectively with fixtures of the upper and lower chord frame structures to define a web structure intermediate said chord frame structures, a fastening means for connecting said struts to said fixtures, and a panel-type conjunctive building component, each of said chord struts comprising an elongated channel member having a relatively flat portion and a pair of vertically extending side portions, said side portions each having a laterally bent out lip portion having a surface portion substantially parallel to the flat portion of said channel and connectable to said component, said chord struts of said lower chord frame having attachment surfaces formed on the upper surface of said lip portions, said upper surfaces in supportive engagement with the lower surface of said component, and a resilient clip having a configuration substantially complementary to that of said chord strut being engaged over said chord strut to retain said component in place in abutment with said lip portion and upper surface portions.

2. The combination of the space framework and a support column for providing a support structure for flat conjunctive building components of the panel and deck type, said framework including a plurality of elongated stress and load transmitting chord struts interconnected by stress load distributing fixtures to define an upper and a lower chord frame structure, said chord frame structures disposed in spaced parallel planes, a plurity of elongated stress and load transmitting web struts, each connecting respectively between the fixtures of the upper and lower chord frame structures to define a web structure intermediate said chord frame structures, and a fastening means for connecting each of said struts of said chord frame structures to its associated fixtures, each of said chord struts comprising an elongated channel member having a relatively flat portion, a pair of vertically extending side portions formed integral with said flat portion and a pair of outwardly bent lip portions thus defining a substantially hat-shaped cross-sectional member, said lip portions engageable with the opposed surface of one of said components, and a fastener means included for holding said lip portions and the opposed surface of said component together in supporting relationship, said chord struts being connected in said lower chord frame structure, said component being of the ceiling panel type, said lip portions being inserted under the edges of said component, and a resilient clip being engageable over the strut, said clip having a pair of laterally extending edge portions for holding said components in place between the edge portions and said chord lip portions.

* * * * *